US005959525A

United States Patent [19]

Black et al.

[11] Patent Number: 5,959,525

[45] Date of Patent: Sep. 28, 1999

[54] VARIABLE RESISTANCE SLIDE CONTROL DEVICE WITH A SWITCH

[75] Inventors: Richard L. Black, Granger; Kevin D. Kurtz, Ft. Wayne, both of Ind.

[73] Assignee: CTS Corporation, Elkhart, Ind.

[21] Appl. No.: 09/132,798

[22] Filed: Aug. 13, 1998

[51] Int. Cl.[6] ..... H01C 10/50

[52] U.S. Cl. ..... 338/198; 338/200; 338/178; 338/179

[58] Field of Search ..... 338/74, 78, 172, 338/178, 179, 198, 200, 191

[56] References Cited

U.S. PATENT DOCUMENTS

| | | | |
|---|---|---|---|
| 3,310,768 | 3/1967 | Opalenik | 338/198 |
| 3,375,446 | 3/1968 | Guyton | 455/220 |
| 3,381,254 | 4/1968 | Campbell | 338/179 |
| 3,622,934 | 11/1971 | Yano et al. | 338/198 |
| 3,887,892 | 6/1975 | Rozema et al. . | |
| 3,918,023 | 11/1975 | Zdanys . | |
| 4,085,399 | 4/1978 | Wall | 338/200 |
| 4,101,864 | 7/1978 | Van Benthuysen . | |
| 4,104,606 | 8/1978 | DeWitt | 338/198 |
| 4,259,619 | 3/1981 | Wall . | |
| 5,144,278 | 9/1992 | Moseley et al. | 338/198 |
| 5,376,764 | 12/1994 | Retter et al. . | |

*Primary Examiner*—Lincoln Donovan
*Assistant Examiner*—Karl Easthom
*Attorney, Agent, or Firm*—Michael W. Starkweather; Mark Bourgeois

[57] ABSTRACT

A variable resistance control device and switch has a base, made of insulating material, a rheostat, mounted to the base, and a switch, mounted to the base. The rheostat includes a variable resistor trace, positioned on the base, a collector trace, positioned on the base next to and insulated from the variable resistor trace. The rheostat includes an actuator, slidably coupled to the base, for sliding over a length of both the variable resistor trace and the collector trace to make electrical contact therebetween. The rheostat also includes a first set of contacts, that are 1) electrically coupled during operation of the rheostat, and are 2) electrically isolated during operation of the switch; and a second set of contacts, that are 1) electrically isolated during operation of the rheostat, and are 2) electrically coupled during the operation of the switch.

8 Claims, 3 Drawing Sheets

VARIABLE RESISTANCE SLIDE CONTROL DEVICE WITH A SWITCH

BACKGROUND OF THE INVENTION

1. Field of the Invention

The present invention relates to a variable resistance control device. In particular, the invention relates to variable resistance slide control having a three-way switch.

2. Description of the Related Art

Variable resistors are known for sensing parameters in a variety of applications. For example, a sliding volume control uses a variable resistor. Light switches in buildings use variable resistors to control the gate of a triac for dimming lights.

3. Related Art

Variable resistance slide controls that are provided with a slider carrying a contactor member that swipingly engages resistance elements and a collector member are well known in the art. Examples of patents related to the present invention are as follows, and each patent is herein incorporated by reference for the supporting teachings:

U.S. Pat. No. 3,887,892, is a variable resistance slide control.

U.S. Pat. No. 3,918,023 is a variable resistance control and method of assembling the same.

U.S. Pat. No. 4,101,864 is a variable resistance slide control.

U.S. Pat. No. 4,259,619 is a three-way light dimmer switch.

U.S. Pat. No. 5,376,764 is a three-way switch.

The foregoing patents reflect the state of the art of which the applicant is aware and are tendered with the view toward discharging applicants' acknowledged duty of candor in disclosing information that may be pertinent in the examination of this application. It is respectfully stipulated, however, that none of these patents teach or render obvious, singly or when considered in combination, applicant's claimed invention.

SUMMARY OF THE INVENTION

It is a feature of the invention to provide a variable resistance control device. In particular, the invention relates to variable resistance slide control having a three-way switch.

An additional feature of the invention is to provide a combination switch and dimmer control, comprising a base, made of insulating material, a rheostat, mounted to the base, and a switch, mounted to the base. The rheostat includes a variable resistor trace, positioned on the base, a collector trace, positioned on the base next to and insulated from the variable resistor trace. The rheostat includes actuator means, slidably coupled to the base, for sliding over a length of both the variable resistor trace and the collector trace to make electrical contact therebetween. The rheostat also includes a first set of contacts, that are 1) electrically coupled during operation of the rheostat, and are 2) electrically isolated during operation of the switch; and a second set of contacts, that are 1) electrically isolated during operation of the rheostat, and are 2) electrically coupled during the operation of the switch.

The invention resides not in any one of these features per se, but rather in the particular combination of all of them herein disclosed and claimed. Those skilled in the art will appreciate that the conception, upon which this disclosure is based, may readily be utilized as a basis for the designing of other structures, methods and systems for carrying out the several purposes of the present invention. Further, the abstract is neither intended to define the invention of the application, which is measured by the claims, neither is it intended to be limiting as to the scope of the invention in any way.

Figure 1:
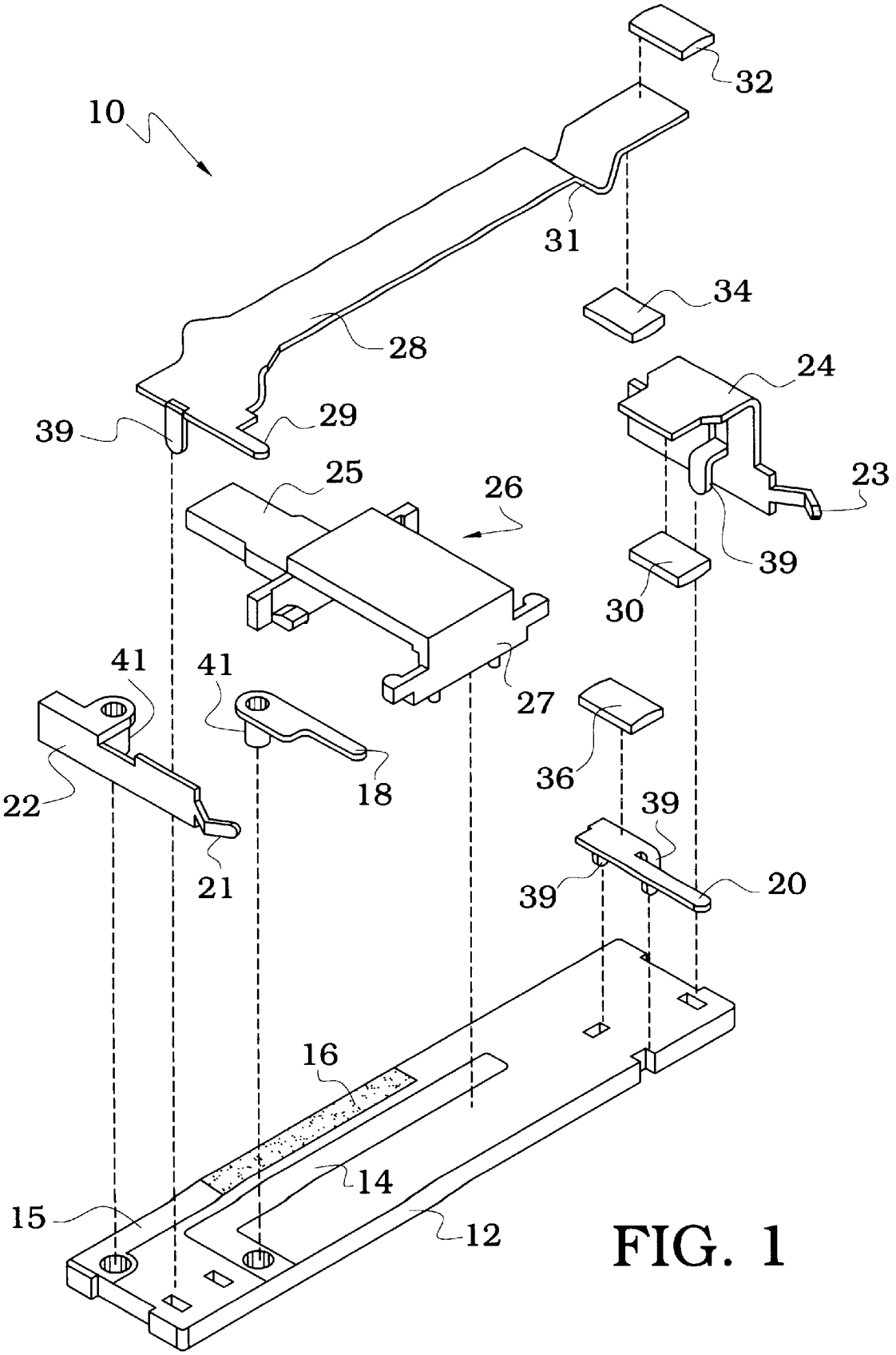
FIG. 1 is an exploded view of the components of the three-way switch variable resistance slide controller.

It is noted that the drawings of the invention are not to scale. The drawings are merely schematic representations, not intended to portray specific parameters of the invention. The drawings are intended to depict only typical embodiments of the invention, and therefore should not be considered as limiting the scope of the invention. In the drawings, like numbering represents like elements between the drawings.

DETAILED DESCRIPTION OF THE PREFERRED EMBODIMENT

Figure 2:
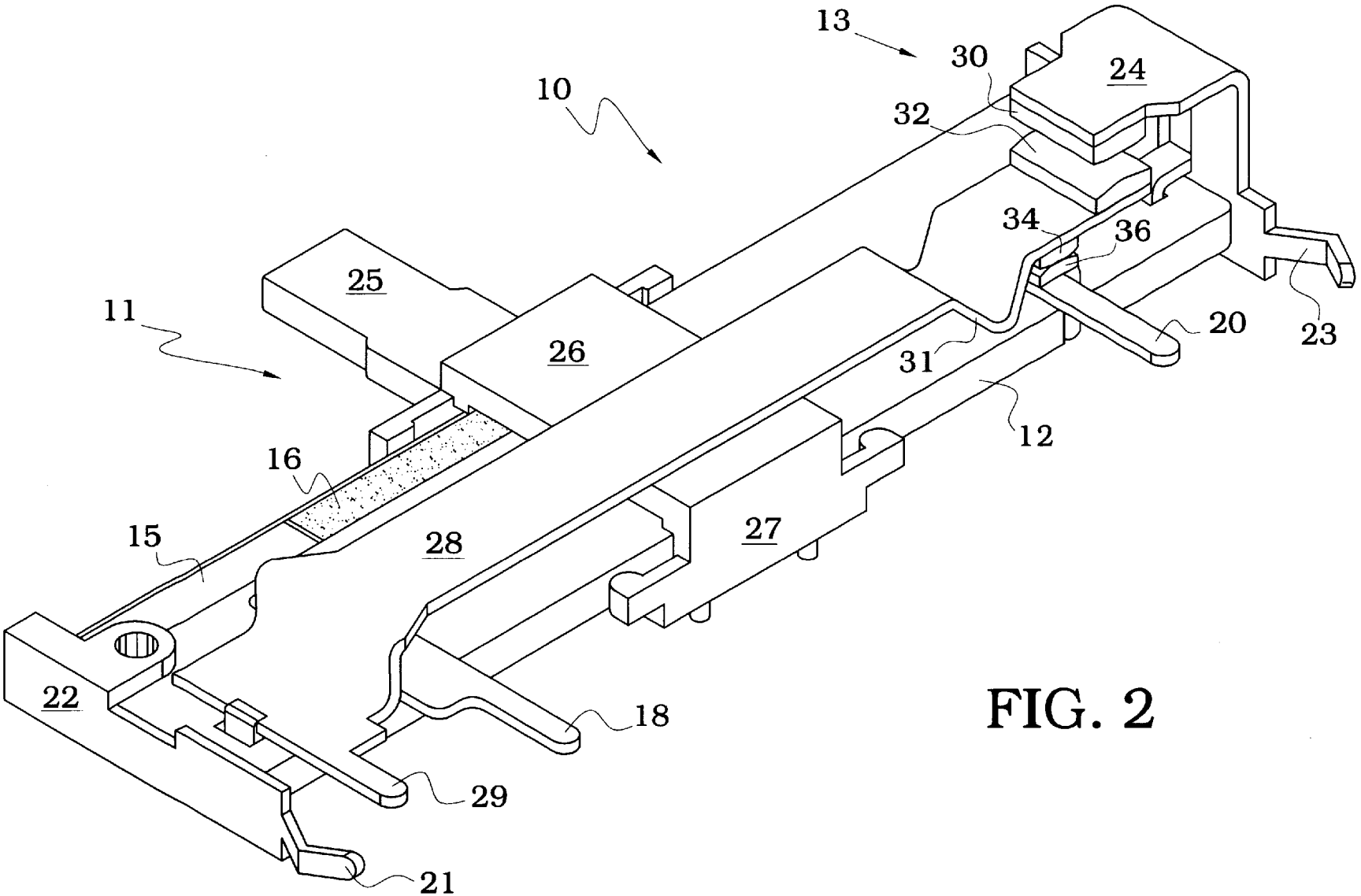
FIG. 2 is an isometric view of the assembled switch of FIG. 1.

The present invention provides a combined three-way switch and variable resistance slide controller 10 as illustrated in FIGS. 1 and 2. In particular, controller 10 (also referred to as a switch 10) includes two parts, a rheostat 11, that operates the variable resistance slide controller, and a switch 13 which is a single pole double throw switch that engages or disengages a separate remote switch or three way switch. The variable resistance slide controller is similar to prior art potentiometer inventions in that it has the same basic components. Namely, a base 12, a resistor 16 and conductor traces 14 and 15 placed on the base, terminals 18 and 22 for coupling to the resistor side (15 and 16) and collector side (14) of the variable resistor. There is also a slide actuator 26, which includes a post 25 for allowing a user to grip the actuator, and a holder 27 for holding the actuator to the base. There are contacts (not shown) that are mounted to the under-side of the actuator for making electrical contact between the resistor side and collector side of the typical potentiometer. A typical variable resistance slide control is illustrated in U.S. Pat. Nos. 4,101,864 and 3,887,892, which have already been incorporated by reference. Further discussion of the operation and particular design details is not deemed necessary and can be further explored if desired by referring to the referenced patents.

Three-way switches are well known in the art, and are exemplified by U.S. Pat. Nos. 5,376,764 and 4,259,619, which have been incorporated by reference. Therefore, the operation of a typical three-way switch will not be presented and can be further explored if desired by referring to the referenced patents.

It is the combination of the three-way switch with the variable resistance slide control that is of importance, as this has not been done in the means provided by the current combination. Specifically, there is designed thereon, a movable spring operated arm 28, having contact buttons 32 and 34 mounted thereon, and a pair of terminals 20 and 24 also having contact buttons 36, and 30 mounted thereon respectively as shown. Solder tabs 18, 20, 21, 23 and 29 are mounted as illustrated for attaching the controller 10 to a printed circuit board for example. Several bent tabs 39 and eyelets 41 extend off the terminals and the arm for securing the components to base 12.

Figure 3:
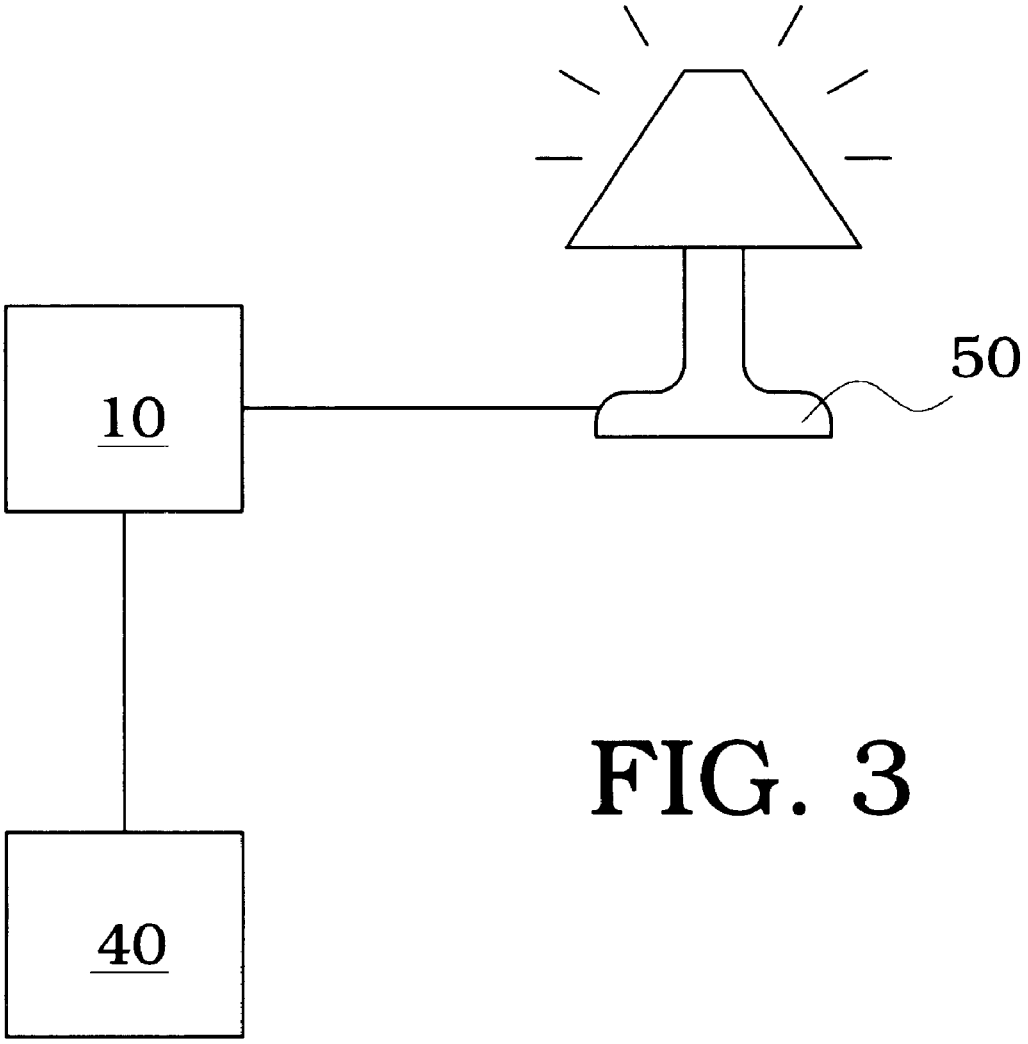
FIG. 3 is an illustration of the invention of FIG. 1 used to activate a light.

In reference to FIG. 1, 2 and 3, one skilled in the art of switches will easily understand the operation of the present inventions. Specifically, switch 10 normally controls the dimming of a light 50 via a conventional triac dimmer by the rheostat operation, for example, by sliding actuator 26 along the length of the resistor 16. However, unlike prior art designs that incorporate only a rheostat 11, when actuator 26 traverses its length of travel and reaches the furthest extent near terminals 20 and 24, spring arm 28 will be engaged by the top surface of actuator 26 at ramp section 31. Engagement of the actuator with the arm causes spring arm 28 to gradually move away from base 12. Separation of the contactors 34 and 36 is thereby achieved, which breaks electrical contact between terminals 20 and 29. As the actuator continues traversing in the same direction, contactors 30 and 32 are thereby engaged, thus completing electrical contact between terminals 23 and 29. This contact will enable remote switch 40 to control light 50, which was previously controlled exclusively by the switch 10. It is noted that the contactors and terminals are designed to be able to switch current levels associated with a standard lighting fixtures, ie, 50 to 600 watts.

Another aspect of the invention is that contact buttons 30, 32, 34 and 36, during contacting, incur a wiping motion. The flexing of spring arm 28 during contacting of buttons 30, 32, 34 and 36 causes a slight rotation of the outer surfaces of the buttons against each other and contributes to the extension of contact life under electrical load by breaking through any accumulated surface oxidation.

Remarks About the Preferred Embodiment

One of ordinary skill in the art of designing and using potentiometers and switches will realize many advantages from using the preferred embodiment. For example, by having all of the various electrical components that operate the three-way switch mounted onto base 12, a small and compact size is achieved to the overall switch 10.

An additional advantage of the preferred embodiment is that arm 28 is mounted over actuator 26 and has no contact with actuator 26 during standard operation of the rheostat 11. However, when the actuator 26 engages ramp 31, the three-way switch 40 is activated, thus allowing the remote switch 40 to control the light 50.

Variations of the Preferred Embodiment

Although the illustrated embodiment discusses a particular arrangement of the combination three-way switch and variable resistor, one skilled in the art will easily realize many variations for the arranged electrical components on the base. For example, although a rheostat 11 is illustrated, it is easily contemplated using a potentiometer design having contacts at both ends of the resistor strip.

Further, it is contemplated to fabricate a rotary version of the invention where the actuator travels along the circumference of an arc or semi-circle and the switch is actuated at one end of the circumferential travel.

Even though the switch and controller 10 was described as controlling a light, a skilled artisan could utilize the invention to control any electrical device such as audio electronics, industrial controls, electronic toys, computer devices, avionic systems, automotive electronics, remote controllers, heating and ventilation controls and dimmable electronic ballasts.

Even though the switch 13 shown was a single pole double throw, the switch 13 could be a single pole single throw or a double pole double throw or a double pole single throw.

Although, there are selected illustrated embodiments, someone skilled in the art will recognize that changes can be made in form and detail without departing from the spirit and the scope of the invention. The described embodiments are to be considered in all respects only as illustrative and not restrictive. The scope of the invention is, therefore, indicated by the appended claims rather than by the description. All changes that come within the meaning and range of equivalency of the claims are to be embraced within their scope.

What is claimed and desired to be secured by patent is:

1. A switch and variable resistance control device, for mounting to a circuit board, comprising:

a) a base;

b) a rheostat, mounted to the base, including:

b1) a variable resistor trace, positioned on the base;

b2) a collector trace, positioned on the base next to and insulated from the variable resistor trace; and b3) linear actuator means, slidably coupled to the base, for sliding linearly over a length of both the variable resistor trace and the collector trace to make electrical contact therebetween; and c) a switch, mounted to the base, including:

c1) an arm disposed above the actuator means so that the actuator is located between the arm and the base, the arm having a ramp;

c2) a first and second contact disposed on each side of the arm;

c3) a third contact disposed close to the first contact; and c4) a fourth contact disposed close to the second contact, the actuator means operable to slide linearly along the length of the arm and the base such that the actuator engages the ramp causing the arm to move between a first position in which the first and third contacts are electrically engaged and the second and fourth contacts are electrically isolated and a second position in which the first and third contacts are electrically isolated and the second and forth contacts are electrically engaged.

2. The switch and dimmer control according to claim 1, wherein the third contact is mounted to a first terminal and the fourth contact is mounted to a second terminal.

3. The switch and dimmer control according to claim 2, wherein a solder tab extends from the first terminal, an end of the arm and the second terminal.

4. The switch and dimmer control according to claim 1 wherein the switch is connected to a remote switch.

5. A combination switch and potentiometer device, comprising:

a) an elongated base, having the potentiometer and switch mounted thereon;

b) a spring arm that extends over the length of the base, having:

b1) a first end that is fixed to one end of the base; and b2) a second end, having a contact means for making switch contact; and c) a linear actuator, slidably coupled between the base and the spring arm, having:

c1) a first position that slidably actuates the potentiometer, and c2) a second position that moves the contact means to operate the switch.

6. The combination of claim 5, wherein the spring arm further comprises a ramp, located to avoid contacting the actuator when in the first position, and shaped to move the contact means when the actuator approaches the second end.

7. The combination of claim 6, wherein the contact means comprises:

a) a first contact button located on the spring arm and facing the base, making electrical contact with a first lead when the actuator is in the first position; and b) a second contact button located on the spring arm facing away from the base, making electrical contact with a second lead when the actuator is in the second position.

8. A switch and variable resistance control device, for mounting to a circuit board, comprising:

a) an elongated base;

b) a variable resistor trace, positioned on the base;

c) a collector trace, positioned on the base next to and insulated from the variable resistor trace;

d) a spring arm, mounted to the base, the arm having a ramp and a first and second contact disposed on each side of the arm, a third contact disposed close to the first contact, and a fourth contact disposed close to the second contact; and e) a linear actuator, located between the spring arm and the base and slidably coupled to the base by a holder that extends over the base, for sliding linearly over a length of both the variable resistor trace and the collector trace to make electrical contact there between, the actuator engaging the ramp such that the ramp causes the arm to move between a first position in which the first and third contacts are electrically engaged and the second and fourth contacts are electrically isolated and a second position in which the first and third contacts are electrically isolated and the second and forth contacts are electrically engaged.

* * * * *